United States Patent [19]

Loomba et al.

[11] 4,068,354

[45] Jan. 17, 1978

[54] SAFETY BELT BUCKLE

[75] Inventors: Yogendra S. Loomba, Washington; Surendra D. Narayan, Warren, both of Mich.

[73] Assignee: Allied Chemical Corporation, N.J.

[21] Appl. No.: 662,988

[22] Filed: Mar. 1, 1976

[51] Int. Cl.[2] ..... A44B 11/26

[52] U.S. Cl. ..... 24/230 A; 24/230 AL

[58] Field of Search ..... 24/230 A, 230 AL, 230 AK, 24/230 AN, 230 AT

[56] References Cited

U.S. PATENT DOCUMENTS

| | | | |
|---|---|---|---|
| 3,605,210 | 9/1971 | Lohr | 24/230 AT |
| 3,631,571 | 1/1972 | Stoffel | 24/230 A |
| 3,649,999 | 3/1972 | Stoffel | 24/230 AT |
| 3,760,467 | 9/1973 | Lohr | 24/230 A |
| 3,895,196 | 7/1975 | Lewis | 24/230 A |
| 3,911,236 | 10/1975 | Poulsen | 24/230 AL |

FOREIGN PATENT DOCUMENTS

| | | | |
|---|---|---|---|
| 116,111 | 11/1942 | Australia | 24/205.17 |
| 1,127,998 | 12/1956 | France | 24/230 AK |
| 825,575 | 12/1959 | United Kingdom | 24/230 AT |

*Primary Examiner*—Bernard A. Gelak
*Attorney, Agent, or Firm*—Ernest D. Buff

[57] ABSTRACT

A safety belt buckle is provided with plural locking features that increase its holding strength and decrease fastening and release effort. The buckle has a housing containing means for receiving the tongue of a seat belt. A latching means engages the tongue and cooperates with a locking means to hold it within the housing. The buckle is small, light, strong, reliable, easy to fasten and unfasten, comfortable to wear and inexpensive to produce.

6 Claims, 5 Drawing Figures

SAFETY BELT BUCKLE

BACKGROUND OF THE INVENTION

1. Field of Invention

This invention relates to safety belt buckles for passengers in vehicles such as automobiles, and more particularly to improved means for housing and facilitating the operation of the components of the buckle.

2. Description of the Prior Art

Safety belt buckles have been developed in order to reduce the number of fatalities and serious injuries resulting from motor vehicle accidents. Most of these buckles include, as major components, a housing connected to a seat belt or strap anchored to the vehicle body and a latching mechanism adapted to coact with the tongue of another seat belt similarly secured to the vehicle. One of the problems encountered with such buckles is the difficulty of inserting the tongue into the housing and removing it therefrom. The magnitude of the biasing force exerted on the latching mechanism to prevent premature ejection of the tongue during collision conditions, provides for rough entry of the tongue upon insertion thereof into the housing and hinders the release effort, or force required to remove the tongue from the housing during normal operation of the vehicle. Another problem with such buckles is the relatively large size, weight and cost thereof. The present invention provides a means whereby the aforesaid problems are overcome.

SUMMARY OF THE INVENTION

In accordance with the present invention a safety belt buckle is provided that is compact, light-weight and strong, and which has plural features that virtually eliminate problems such as rough entry, premature ejection, high fastening and release effort and the like. The buckle has a housing having an opening therein and provided with a cavity extending from the opening to a wall of the housing opposite the opening. An inlet means of the housing communicates with the cavity for receiving the tongue of a seat belt. A connecting means is provided for connecting the housing to an anchorage point on the vehicle. The buckle has a latching means for engaging the seat belt tongue. A first biasing means connected to said housing biases the latching means into engagement with the tongue. The housing has a locking means slidably mounted thereon. A second biasing means connected to the housing biases the locking means into locking engagement with the latching means. A release means is slidably mounted on the housing for rotating the latching means to move the locking means out of locking engagement therewith.

The safety belt buckle of this invention has advantageous structural features. A unique coaction between the locking means and the latching means reduces the magnitude of forces applied against the latter during collision of the vehicle. The force provided by the first biasing means can be decreased, hard points within the housing cavity are removed and the release effort is reduced. Buckle holding strengths are increased and the size and weight of the buckle assembly is decreased. As a result, safety belt buckles incorporating the present invention are less expensive to produce, easier to fasten, more comfortable to wear and afford greater protection to vehicle occupants than previous safety belt buckles.

BRIEF DESCRIPTION OF THE DRAWINGS

The invention will be more fully understood and further advantages will become apparent when reference is made to the following detailed description and the accompanying drawings in which.

DESCRIPTION OF THE PREFERRED EMBODIMENT

Figure 1:
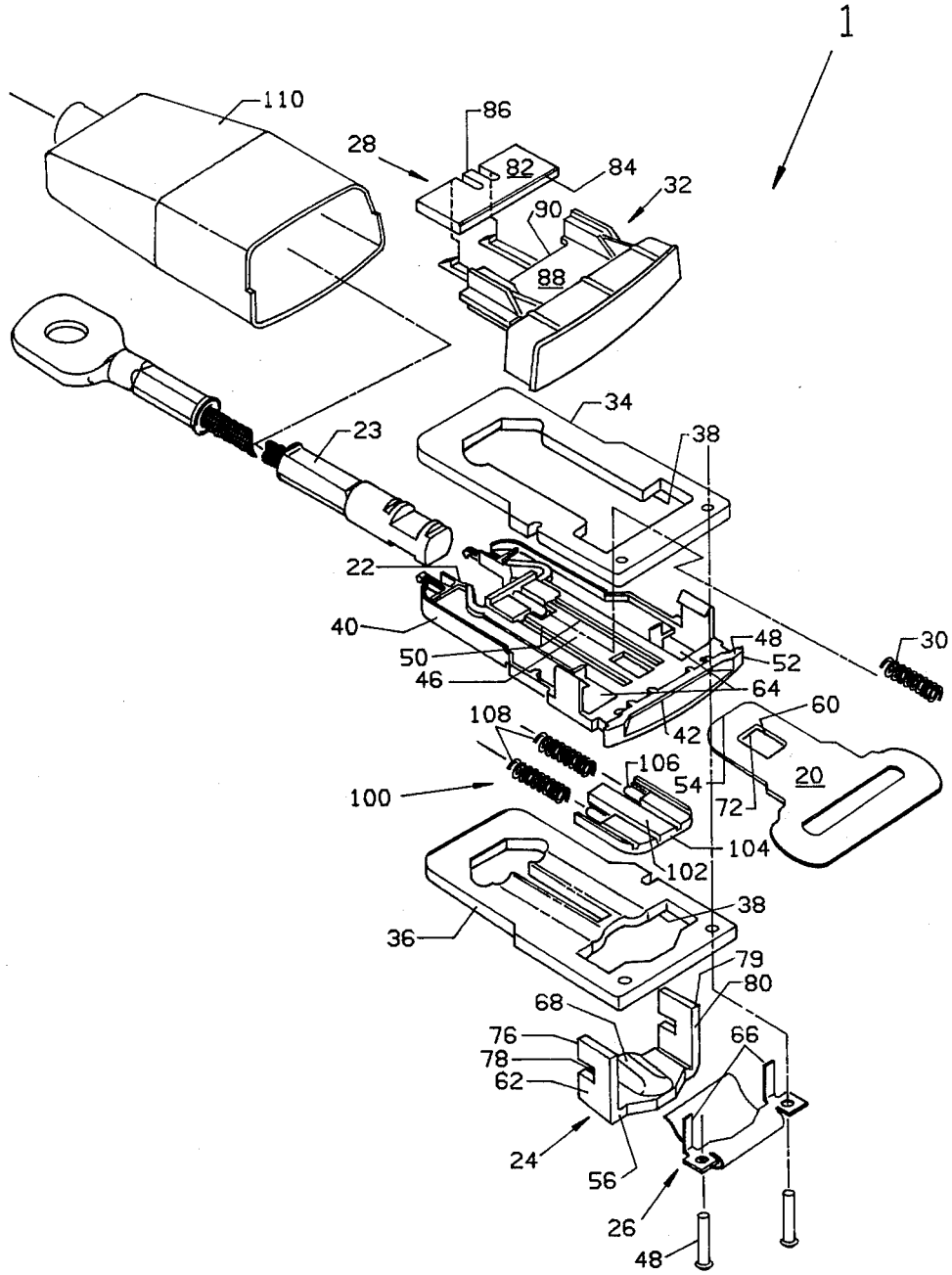
FIG. 1 is an exploded view illustrating the safety belt buckle of this invention.

Referring to the drawings, there is illustrated one form of a safety belt buckle incorporating the present invention. Other forms of the safety belt buckle can also be used. The buckle, shown generally at 1 in the drawings, should therefore be interpreted as illustrative and not in a limiting sense. As illustrated, the buckle 1 includes a housing 10, shown generally at 10, having an opening 12 therein from which a cavity 14 extends to a wall 16 of the housing 10 opposite the opening 12. Housing 10 is provided with an inlet means 18 which communicates with the cavity 14 for receiving the tongue 20 of a seat belt. The housing 10 has a connecting means 22 for connecting the housing through a connector element 23, seat belt (not shown) or the like, to an anchorage point on the vehicle (not shown). A latching means, shown generally at 24, is provided for engaging the seat belt tongue 20. The buckle 1 has a first biasing means 26 connected to housing means 10 for biasing latching means 24 into engagement with tongue 20. Slidably mounted on housing 10 is a locking means, shown generally at 28. A second biasing means 30 connected to the housing 10 biases the locking means 28 into locking engagement with the latching means 24. A release means shown generally at 32 is slidably mounted on housing 10 for rotating the latching means 24 to move the locking means 28 out of locking engagement with the latching means 24.

Housing 10 is preferably formed of a plurality of laminated plates. As shown in FIG. 1, the top and bottom plates 34 and 36, respectively, have an opening 38 in the central portion thereof and the center plate 40 has an opening 42 extending from an edge 44 of the plate 40 into the central portion thereof, the opening 44 forming part of the inlet means 18. The center plate 40 has a guide means, generally indicated at 46, extending from the interior of the cavity to a point of termination 48 on the exterior surface of the housing 10 for guiding the tongue 20 into the cavity 14 of the housing 10.

The number of laminated plates employed can vary depending on the depth of the cavity and the type of material of the plates. Typically, the top and bottom plates 34 and 36 are die stamped from metal such as steel, aluminum or the like, and the center plate is injection molded or otherwise formed of a polymeric material. Suitable polymeric materials include thermoplastic resins such as acetal homopolymer or copolymer or polycarbonate, as well as thermosetting resins such as of the phenolic type. Preferably the housing 10 is composed of at least three plates, including top center and bottom plates. Each of the plates 34, 36 and 40 are formed using conventional equipment at very low cost.

The housing 10 is assembled by sandwiching first biasing means 26 and bottom and top plates 36, 34, respectively about center plate 40 and fastening the assembled plates together by mechanical fastening means, such as rivets 48. The plates can, alternatively, be spot-welded or adhesively secured together using suitable epoxy resins or the like. Upon assembly of the plates to form an integral laminated housing unit, guide means 46 is formed by spaced apart parallel walls 50 and bell-shaped extension 52 of which center plate 40 is comprised. The wall 50 and the extension 52 cooperate with the tip 54 of the tongue 20 to provide for smooth entry of the tongue 20 into cavity 14.

Figure 2:
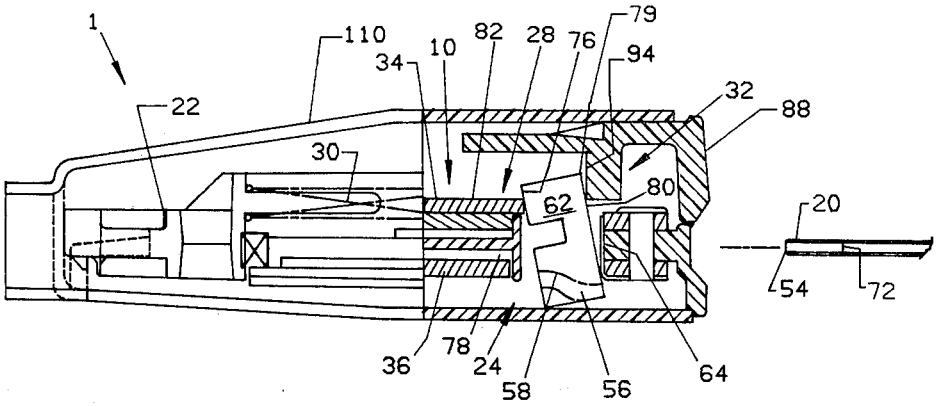
FIGS. 2 and 3 are sectional views of the buckle of FIG. 1, showing the relationship between the latching means, locking means and housing means.
Figure 3:
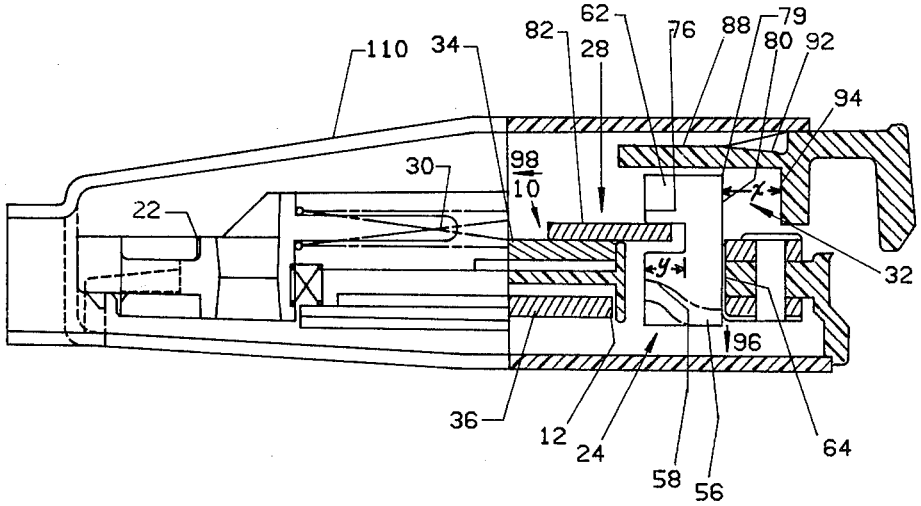
Figure 4:
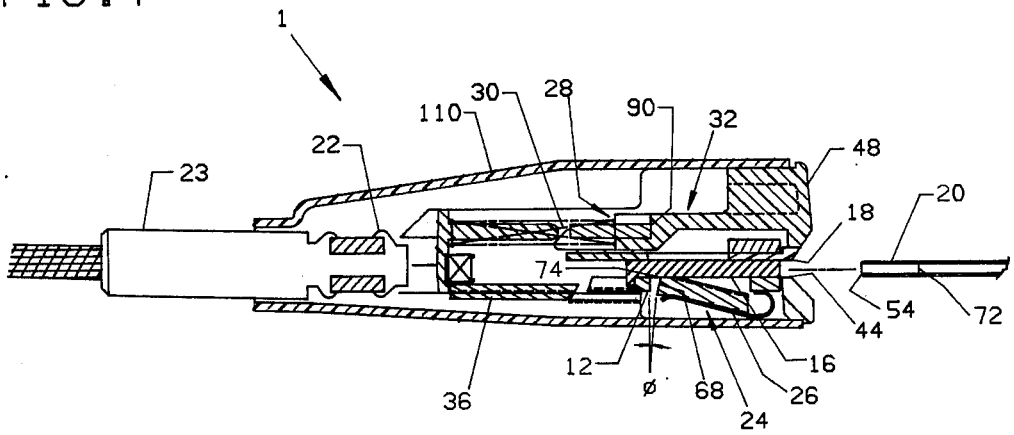
FIGS. 4 and 5 are sectional views of the buckle of FIG. 1, showing the relationship between the biasing means, latching means, locking means and housing means.
Figure 5:
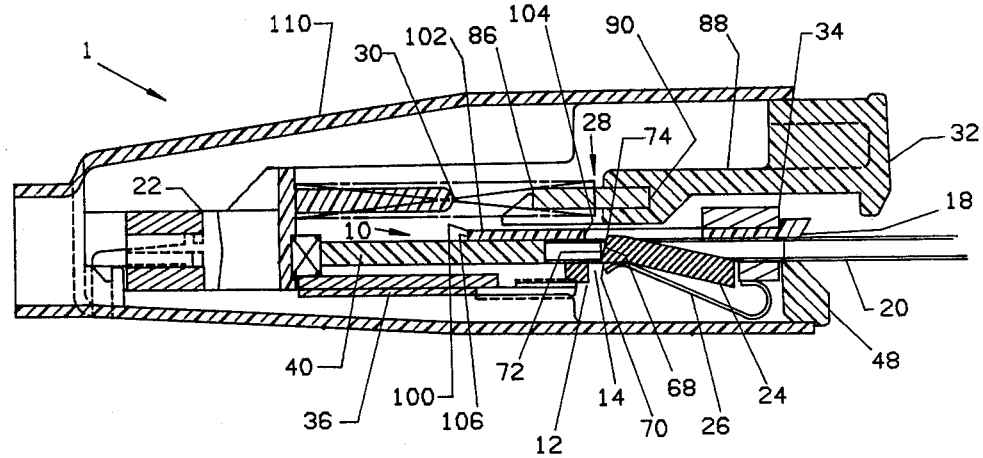

Referring to FIGS. 2–3 of the drawings, a latching means 24 and locking means 28 are shown in relation to the housing 10. The latching means 24 includes a biasing means 26, a latch bar 56 having a raised portion 58 adapted to mate with opening 60 of tongue 20. As best shown in FIGS. 4–5, mating end 68 of latch bar 56 has a beveled configuration. More specifically, the mating end 68 has a bottom edge 70 engaging the mating wall 72 of tongue 20 and the top edge 74 inclined away from said mating wall, the angle of inclination, $\phi$, from said mating wall being about 3.0° to 30.0°. Latch bar 56 has a plurality of shoulders 62 adapted to move within passages 64 of center plate 40. End portion 66 of first biasing means 26 extends into passages 64 and provides smooth, continuous surface for co-action with latch bar 56. Each of shoulders 62 has a rear face 76 having a notch 78 therein and a forward face 80 having an angular or corner-like configuration, such as corner 79.

Locking means 28 comprises a lock bar 82 having a forward face 84 adapted to mate with the notch 78 of each shoulder 62 and a rear face 86 connected to the second biasing means 30. Release means 32 can comprise a release bar 88 having a first portion 90 for engaging the forward face 84 of said lock bar and a second portion 92 provided with a step 94 adapted to engage corner 79 on the forward face 84 of each shoulder 62. The first biasing means 26 latch bar 56 lock bar 82 and release bar 88 are disposed in the cavity 14 with at least portions thereof positioned in serial overlapping relationship in the direction in which the cavity extends into the housing. Preferably, a cover 110 is disposed around the housing 10. The cover 110 comprises a single piece of light weight plastic or the like. Cover 110 does not add appreciably to the strength or weight of the assembly but functions primarily to protect the components therein against contamination and accidental damage due to tampering. The cover 110 has sufficient strength and rigidity to withstand forces generated during movement of the release means 32, and may be used to support the first biasing means 26. Preferably, the first biasing means 26 is secured to housing 10 by the mechanical fastening means and does not contact the cover 110 when the latching means 24 is in the latched and unlatched positions. In the latter embodiment, the latching means 24 is functionally independent of the cover 110 and is not disabled by damage thereto. Latching means 24, locking means 28 and release means 32 can be arranged so that the distance, $x$, traveled by step 94 against the bias of second biasing means 30 is greater than the depth, $y$, of each notch 78. This arrangement of the latching means 24, locking means 28 and release means 32 minimizes the release effort, or force required to remove tongue 20 from housing 10 during normal operation of the vehicle.

In operation, the tongue 20 is inserted into inlet means 18 and cavity 14, bringing opening 60 above raised portion 58 of latch bar 56. The first biasing means 26 moves the raised portion 58 into engagement with opening 60 of tongue 20, while second biasing means 30 moves forward face 84 of lock bar 82 into engagement with notch 78 of latch bar 56, locking tongue 20 in housing 10. Due to the beveled configuration of mating end 68 relative to mating wall 72 of tongue 20, tensile forces applied against the tongue during collision conditions are transferred, in part, to lock bar 82. The latter cooperates with latch bar 56 to hold tongue 20 securely within housing 10. Movement of the release bar 88 toward lock bar 82 brings step 94 into contact with corner 79 on forward face 80 of shoulders 62. Latch bar 56 rotates downwardly in the direction of arrow 96. Simultaneously, lock bar 82 is displaced in the direction of arrow 98 against the bias of second biasing means 30 until forward face 84 is removed from notch 78. Depression of the latch bar 56 brings raised portion 58 below opening 60 of tongue 20, with the result that the tongue 20 can be freely removed from the housing 10. In order to further facilitate removal of tongue 20 from housing 10, the buckle 1 can be provided with an ejecting means 100, shown generally at 100, including an ejecting slide 102 having a forward edge 104 adapted to engage the tip 54 of tongue 20 and a rear edge 106 connected to a third biasing means 108. The third biasing means 108 exerts a biasing force on ejecting slide 102 which is applied against tip 54 of tongue 20 to station the tongue 20 in the housing 10 and urge it therefrom upon actuation of release means 32.

Having thus described the invention in rather full detail, it will be understood that these details need not be strictly adhered to but that various changes and modifications may suggest themselves to one skilled in the art, all falling within the scope of the invention as defined by the subjoined claims.

I claim:

1. A vehicle safety belt buckle comprising:

a. a housing having an opening therein and provided with a cavity extending from said opening to a wall of said housing opposite said opening;

b. inlet means communicating with said cavity for receiving a tongue of a seat belt;

c. connecting means for connecting the housing to an anchorage point on the vehicle;

d. latching means having a raised portion for engaging said tongue and a plurallity of shoulders each of said shoulders having a notch therein and a forward face having a corner;

e. first biasing means connected to said housing for biasing said latching means into engagement with said tongue;

f. locking means slidably mounted on said housing for locking engagement with said latching means said locking means including a lock bar having a forward face adapted to mate with the notch of each shoulder to form said locking engagement;

g. second biasing means connected to said housing and to said lock bar for biasing said lock bar of said locking means into said locking engagement; and h. release means slidably mounted on said housing for rotating said latching means to move said locking means out of locking engagement therewith.

2. A vehicle safety belt buckle as recited in claim 1, wherein said raised portion is adapted to mate with an opening in said tongue, the mating end of said raised portion being beveled.

3. A vehicle safety belt buckle as recited in claim 2 wherein said mating end has a bottom edge engaging a mating wall of said tongue and a top edge inclined away from said mating wall, the angle of inclination from said mating wall being about 3° to 30°.

4. A vehicle safety belt buckle as recited in claim 2, wherein said release means includes a release bar having a first portion engaging said forward face of said lock bar and a second portion provided with a step adapted to engage the corner on the forward face of each shoulder whereby movement of said release means toward said lock bar rotates said latching means out of engagement therewith releasing said tongue.

5. A vehicle safety belt buckle as recited in claim 2, wherein said housing is formed of a plurality of laminated plates, including top, center and bottom plates, each of said top and bottom plates have an opening in the central portion thereof and said center plate is made of a polymeric material, said center plate having an opening extending from an edge of the plate into the central portion thereof, said opening forming a part of said inlet means and said center plate further including guide means extending from the interior of said cavity to a point of termination on the exterior surface of said housing, for guiding said tongue into said housing.

6. A vehicle safety belt as recited in claim 4 wherein the distance traveled by said step against the bias of said second biasing means is greater than the depth of each notch.

* * * * *

UNITED STATES PATENT AND TRADEMARK OFFICE

CERTIFICATE OF CORRECTION

PATENT NO. : 4,068,354

DATED : January 17, 1978

INVENTOR(S) : Yogendra S. Loomba and Surendra D. Narayan

It is certified that error appears in the above-identified patent and that said Letters Patent are hereby corrected as shown below:

Column 1, line 36, after "plural" insert -- locking --.

Column 4, line 52, "plurallity" should read -- plurality--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*